US008267120B2

(12) United States Patent
Fry et al.

(10) Patent No.: US 8,267,120 B2
(45) **Date of Patent: *Sep. 18, 2012**

(54) CONTROL VALVE ASSEMBLY FOR LOAD CARRYING VEHICLES

(75) Inventors: Lawrence J. Fry, Lexington, KY (US); Joseph W. Lehmann, Atlanta, GA (US); Michael P. Haskin, Georgetown, TX (US); Gregory W. Peterson, Nicholasville, KY (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/157,726

(22) Filed: Jun. 10, 2011

(65) Prior Publication Data

US 2011/0248195 A1 Oct. 13, 2011

Related U.S. Application Data

(63) Continuation of application No. 12/327,291, filed on Dec. 3, 2008, now Pat. No. 7,980,269.

(51) Int. Cl.
*F15B 13/043* (2006.01)

(52) U.S. Cl. ..... 137/625.64; 137/625.66; 137/625.69; 105/286

(58) Field of Classification Search ..... 105/271, 105/274, 286; 137/596, 596.14, 596.16, 137/596.18, 625.6, 625.69, 625.66, 625.64, 137/625.65

See application file for complete search history.

(56) References Cited

U.S. PATENT DOCUMENTS 1,620,023 A 3/1927 Hosceit
2,019,486 A 11/1935 Ernst et al.
2,686,479 A 8/1954 Shields et al.
2,991,730 A 7/1961 Arbel
3,434,390 A 3/1969 Weiss
3,596,565 A 8/1971 Atkinson
3,596,609 A 8/1971 Ortner et al.
3,602,245 A 8/1971 Meisel
3,828,948 A 8/1974 Peterson
RE28,433 E 5/1975 Ronayne et al.
3,994,473 A 11/1976 Wilke
4,011,891 A 3/1977 Knutson et al.
4,067,357 A * 1/1978 Ruchser ..... 137/596.16
4,153,168 A 5/1979 Reustle (Continued)

OTHER PUBLICATIONS

Bosch Rexroth Group, Pneumatic Directional Valves, Industrial Type, Bosch Rexroth Corporation Catalog, Hopper Dump Valve, Part No. P-060681-00001 (12 VDC), Feb. 2007, p. 67.

(Continued)

*Primary Examiner* — Craig Schneider
(74) *Attorney, Agent, or Firm* — Michael Best & Friedrich LLP

(57) ABSTRACT

A control valve assembly is provided for a load carrying vehicle that includes a storage space and a dumping mechanism. The control valve assembly includes a housing and a sliding valve positioned within the housing and movable between a first position, and a second position. The sliding valve includes a first piston that defines a first piston first surface and a first piston second surface, and a second piston that defines a second piston first surface and a second piston second surface. The first piston second surface faces the second piston first surface. A pilot system includes a first pilot passage in fluid communication with the first piston second surface to selectively actuate the sliding valve toward the first position, and a second pilot passage in fluid communication with the second piston first surface to selectively actuate the sliding valve toward the second position.

18 Claims, 8 Drawing Sheets

U.S. PATENT DOCUMENTS

| | | | |
|---|---|---|---|
| 4,185,660 | A | 1/1980 | Faix |
| 4,523,513 | A | 6/1985 | Gudat et al. |
| 4,627,468 | A | 12/1986 | Wilke et al. |
| 4,677,917 | A | 7/1987 | Dugge et al. |
| 4,833,972 | A | 5/1989 | Bohusch et al. |
| 5,016,519 | A | 5/1991 | Goedecke et al. |
| 5,115,720 | A | 5/1992 | Babson et al. |
| 5,359,942 | A | 11/1994 | Ward |
| 5,375,625 | A | 12/1994 | Reynolds |
| 5,419,262 | A | 5/1995 | Turpin, Sr. |
| 5,423,268 | A | 6/1995 | Bounds |
| 5,816,131 | A | 10/1998 | Tornatore |
| 6,405,658 | B1 | 6/2002 | Taylor |
| 6,557,452 | B1 | 5/2003 | Morroney et al. |
| 6,955,126 | B2 | 10/2005 | Taylor |
| 7,055,440 | B2 | 6/2006 | Sisk |
| 7,080,599 | B2 | 7/2006 | Taylor |
| 7,328,661 | B1 | 2/2008 | Allen et al. |
| 7,331,295 | B1 | 2/2008 | Marchiori |
| 2004/0237768 | A1 | 12/2004 | Barber |
| 2004/0261608 | A1 | 12/2004 | Bugel et al. |
| 2006/0185553 | A1 | 8/2006 | Taylor |
| 2007/0107624 | A1 | 5/2007 | Taylor |
| 2007/0129858 | A1 | 6/2007 | Herzog et al. |
| 2007/0175357 | A1 | 8/2007 | Dorian et al. |
| 2007/0245923 | A1 | 10/2007 | Galvan |

OTHER PUBLICATIONS

LEXAIR, Inc., 2-Way Normally Closed Direct Pilot Operated Valves, Apr. 6, 2008, 3 pages, retrieved from http://www.lexairinc.com/valves/rr-sec-gen-spo-pr.html and http://www.lexairinc.com/valves/manuals/SecGenRCalveOpInstructions%20REV%201.pdf.

WABCO Fluid Power Division, 3/4 Super Spool Valve Manual & Pilot Operated Outline, Jul. 30, 1971, admitted prior art.

* cited by examiner

CONTROL VALVE ASSEMBLY FOR LOAD CARRYING VEHICLES

RELATED APPLICATIONS

This application is a continuation of U.S. application Ser. No. 12/327,291, filed on Dec. 3, 2008, the contents of which are incorporated herein by reference in their entirety.

BACKGROUND

The present invention relates to control valves used in railcars or other load carrying vehicles. Specifically, the invention relates to control valves that control the opening and closing of a hopper gate on the underside of a railcar or other load carrying vehicles.

Control valves are typically used within hydraulic or pneumatic systems to direct flow to actuators and to generally control the flow path of a control fluid to insure proper operation of the system. Such control valves may be used with a pneumatic system such as those used with coal carrying railcars. Briefly, coal carrying railcars include a hopper gate on the underside of the railcar that opens and closes to dump coal from the railcar when over a dump site. The hopper gate is opened and closed by a pneumatic cylinder that is controlled by the control valve. As the railcar approaches the dump site, an air system is pressurized to prepare for dumping. When the railcar arrives at the dump site, the control valve provides pressurized air to the cap side of a piston such that the piston pushes the hopper gate open to dump the coal. After the coal has been dumped, the control valve is actuated to the closed position and the piston is refracted such that the hopper gate is closed and locked.

SUMMARY

In one embodiment, the invention provides a control valve assembly for a load carrying vehicle that includes a storage space and a dumping mechanism movable between an open position that allows access to the storage space and a closed position that inhibits access to the storage space. The control valve assembly includes a housing and a sliding valve positioned within the housing and movable between a first position, wherein the dumping mechanism is moved toward the open position, and a second position, wherein the dumping mechanism is moved toward the closed position. The sliding valve includes a first piston that is coupled to a first end of the sliding valve. The first piston defines a first piston first surface and a first piston second surface. A second piston is coupled to a second end of the sliding valve opposite the first end and defines a second piston first surface and a second piston second surface. The first piston second surface faces the second piston first surface. The control valve assembly further includes a pilot system that includes a first pilot passage in fluid communication with the first piston second surface to selectively actuate the sliding valve toward the first position, and a second pilot passage in fluid communication with the second piston first surface to selectively actuate the sliding valve toward the second position.

In another embodiment, the invention provides a control valve assembly for a load carrying vehicle that includes a storage space and a dumping mechanism movable between an open position that allows access to the storage space and a closed position that inhibits access to the storage space. The control valve assembly includes a housing and a sliding valve positioned within the housing and movable between a first position, wherein the dumping mechanism is moved toward the open position, and a second position, wherein the dumping mechanism is moved toward the closed position. The sliding valve includes a first piston coupled to a first end of the sliding valve, and a second piston coupled to a second end of the sliding valve opposite the first end. A pilot system includes a first pilot passage in fluid communication with the first piston to selectively actuate the sliding valve toward the first position, and a second pilot passage in fluid communication with the second piston to selectively actuate the sliding valve toward the second position. A solenoid system includes a first solenoid in fluid communication with the first piston to selectively actuate the sliding valve toward the second position, and a second solenoid in fluid communication with the second piston to selectively actuate the sliding valve toward the first position. The pilot system and the solenoid system are fluidly isolated from one another.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
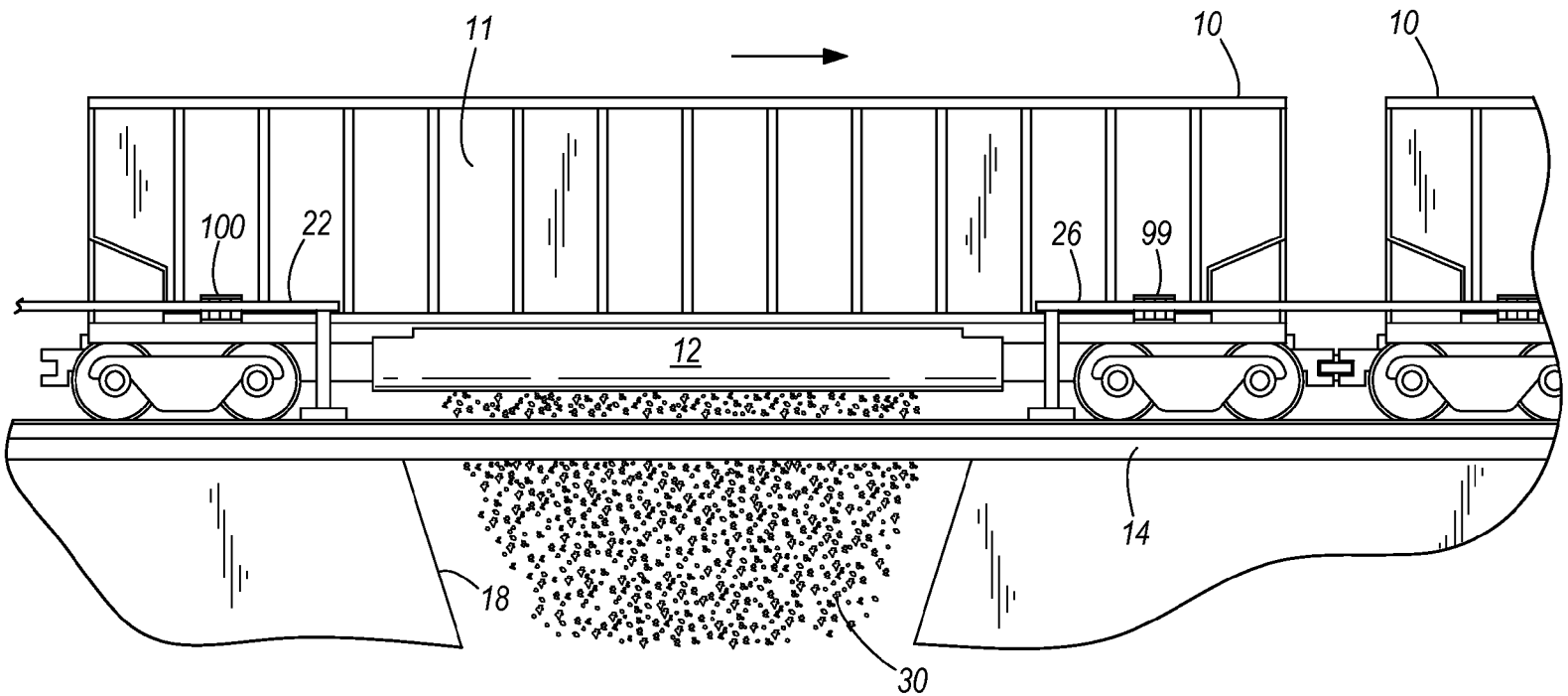
FIG. 1 is a schematic of a vehicle at a dump site.

FIG. 1 shows a load carrying vehicle in the form of a railcar 10. The railcar 10 includes a storage space 11 on the interior of the railcar 10 and a dumping mechanism 12 at the bottom of the storage space 11. The dumping mechanism 12 includes a hopper gate or doors that open and close to selectively provide access to the storage space 11. In the illustrated embodiment, the railcar 10 rides along a rail 14 and is pictured at a dump site 18. The dump site 18 includes a first actuator in the form of an "open" hot rail 22 and a second actuator in the form of a "close" hot rail 26. The illustrated railcar 10 carries a product in the form of coal 30 within the storage space 11 and dumps the coal 30 via the dumping mechanism 12 into the dump site 18. In other embodiments, the load carrying vehicle may be different (e.g., a truck) and may carry a different product (e.g., aggregate), as desired. In another embodiment, the first actuator and second actuator may be configured differently. For example, the hot rails 22, 26 may be removed and a different actuation system may be used, as desired.

Figure 2:
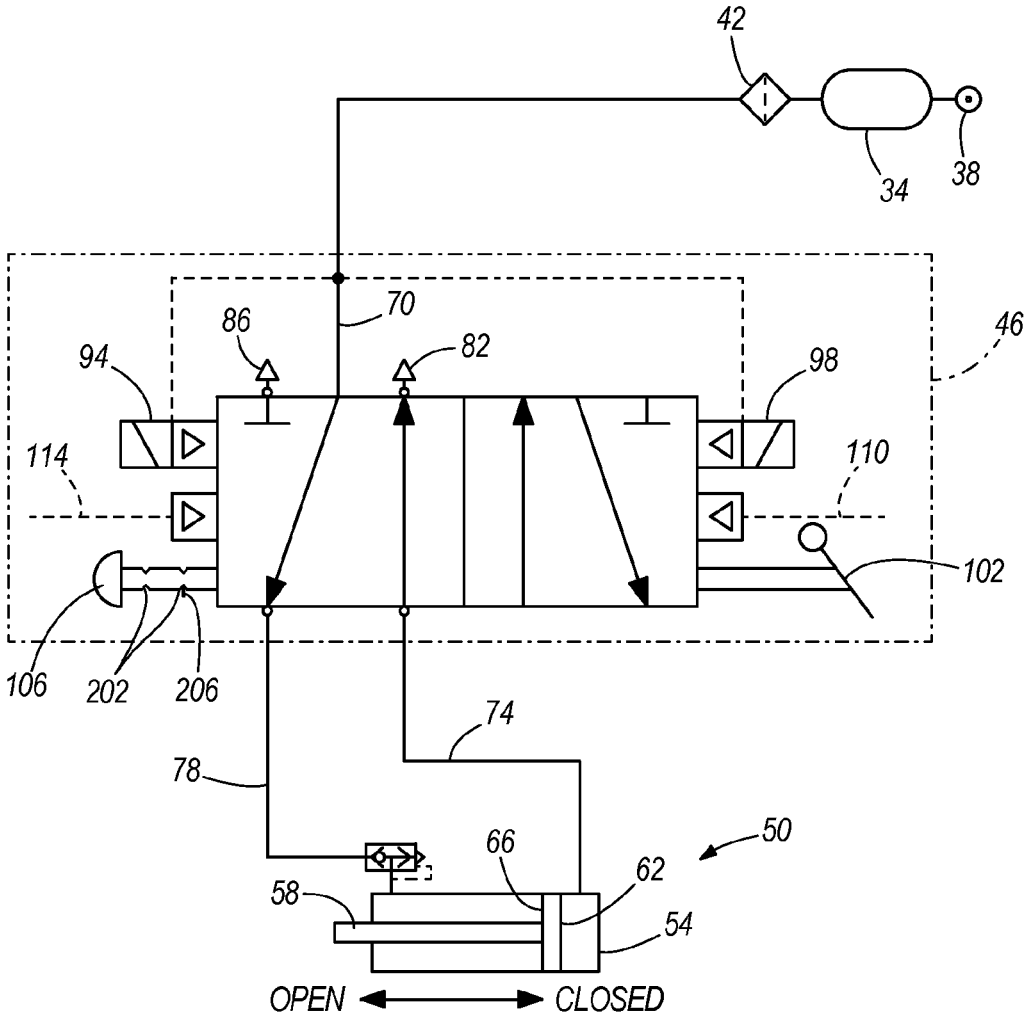
FIG. 2 is a schematic diagram of the pneumatic system of the vehicle of FIG. 1 embodying the invention.
Figure 3:
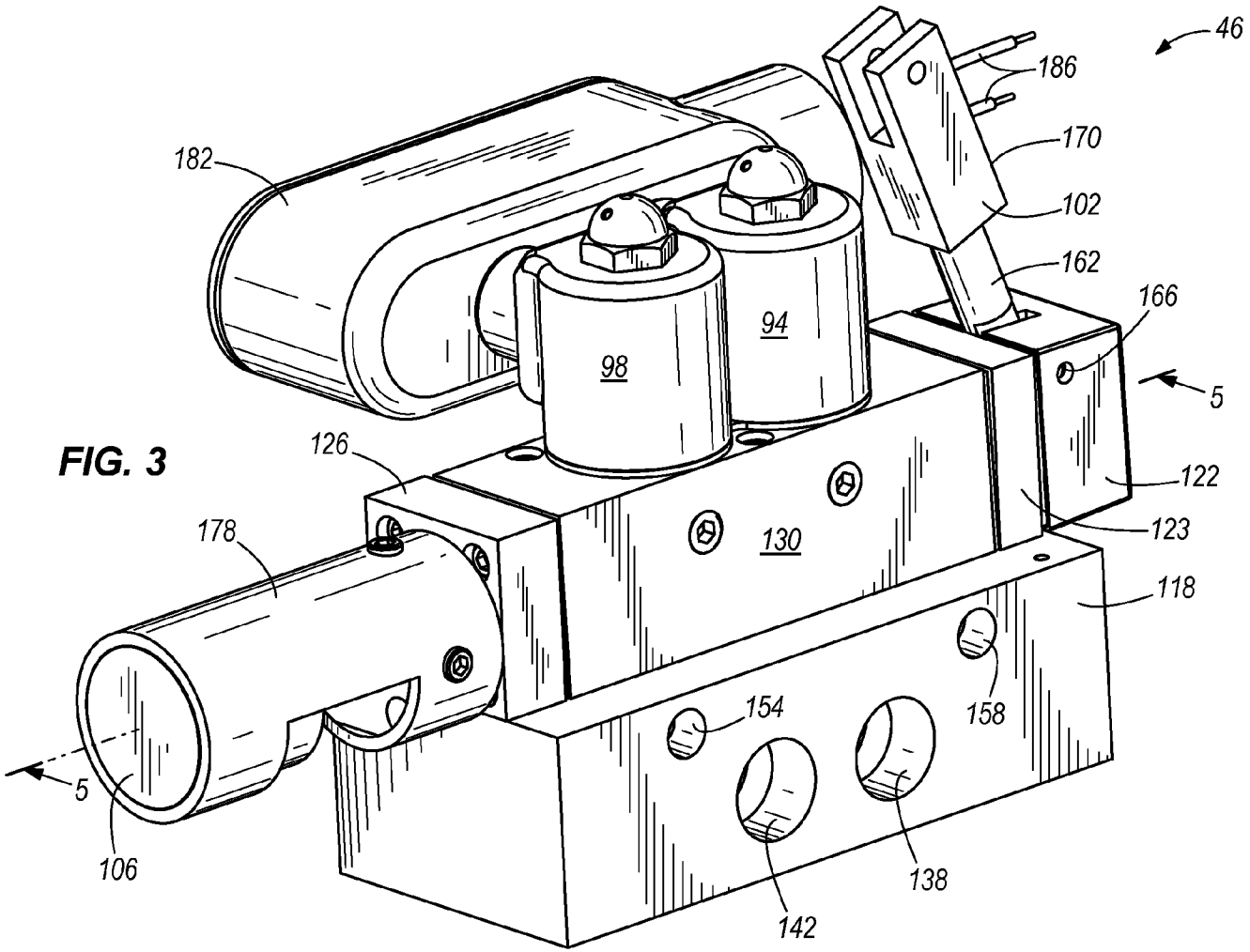
FIG. 3 is a perspective view of a control valve assembly embodying the system shown in FIG. 2.

Referring to FIG. 2, the railcar 10 includes a working fluid tank in the form of a compressed air tank 34 that is filled by an air compressor 38 situated elsewhere on the train or at the dump site 18. The air flows from the compressed air tank 34, through a filter 42 to a control valve assembly 46. The control valve assembly 46 selectively routes air to an actuator 50 to open and close the dumping mechanism 12.

The illustrated actuator 50 is a pneumatic cylinder 54 and piston 58 arrangement. The piston 58 has a cap side 62 and a head side 66. When high pressure air is applied to the cap side 62, the piston 58 is extended from the cylinder 54 (to the left in FIG. 2) such that the dumping mechanism 12 is opened. In one embodiment, the high pressure air must drive the piston 58 past a first detent and a second detent (not shown) to open the dumping mechanism 12. When high pressure air is applied to the head side 66, the piston 58 is retracted into the cylinder 54 (to the right in FIG. 2) such that the dumping mechanism 12 is closed. In other embodiments, a different working fluid may be used (e.g., hydraulic fluid) and the first and/or second detents may be removed, as desired.

The control valve assembly 46 has a supply line 70 that is in communication with the compressed air tank 34 such that the supply line 70 is supplied with high pressure air. The control valve assembly 46 also includes an open line 74 that is in communication with the cap side 62 of the piston 58, a close line 78 that is in communication with the head side 66 of the piston 58, an open exhaust 82 in communication with atmospheric pressure, and a close exhaust 86 in communication with atmospheric pressure.

The illustrated control valve assembly 46 is a two position, five port valve that selectively routes high pressure air from the supply line 70 to either the open line 74 or the close line 78, and selectively vents air from either the cap side 62 of the piston 58 via the open line 74 through the open exhaust 82, or the head side 66 of the piston 58 via the close line 78 through the close exhaust 86. In other embodiments, the open exhaust 82 and close exhaust 86 may be combined into a common exhaust. In such an embodiment, a two position, four port valve configuration could be used.

The control valve assembly 46 includes a valve in the form of a sliding spool valve having a movable spool 90 (FIGS. 5 and 6) that is movable between a close position (as shown in FIG. 2) wherein air from the supply line 70 is provided through the close line 78 to the head side 66 of the piston 58 to move the piston 58 toward the closed position, and an open position (the left half of the spool 90 shown in FIG. 2) wherein air from the supply line 70 is provided through the open line 74 to the cap side 62 of the piston 58 to move the piston 58 toward the open position. When the spool 90 is in the close position, air from the cap side 62 of the piston 58 is vented through the open line 74 and out the open exhaust 82. When the spool 90 is in the close position, air from the head side 66 of the piston 58 is vented through the close line 78 to the close exhaust 86. The close exhaust 86 is blocked when the spool 90 is in the close position and the open exhaust 82 is blocked when the spool 90 valve is in the open position. In other embodiments, other types of valves having a different movable member that switches the valve between two or more positions can also be substituted.

The control valve assembly 46 includes a first actuation system in the form of an "open" solenoid 94 and a "close" solenoid 98. The illustrated open solenoid 94 is in electrical communication with an open hot shoe/touch pad 99 on the railcar 10 that selectively contacts the open hot rail 22. When the open hot shoe/touch pad 99 contacts the open hot rail 22, an electric signal is provided to the open solenoid 94 such that the open solenoid 94 moves the spool 90 to the open position. The illustrated close solenoid 98 is in electrical communication with a close hot shoe/touch pad 100 on the railcar 10 that selectively contacts the close hot rail 26. When the close hot shoe/touch pad 100 contacts the close hot rail 26, an electric signal is provided to the close solenoid 98 such that the close solenoid 98 moves the spool 90 to the close position. In another embodiment, the hot shoe/touch pads 99, 100 may be, for example, simply a disc, washer, or plate that is mounted on the side of the railcar 10. Additionally, the electrical signals may be sent to the hot shoes/touch pads 99, 100 from another source (e.g., a hand held battery, another DC source, or an AC source). In the case of the supply voltage being an AC signal, the hot shoe/touch pad 99, 100 may include a transformer or another voltage manipulation device. In another embodiment, the open hot shoe/touch pad 99 and the close hot shoe/touch pad 100 can be a single hot shoe (not shown), such that when the single hot shoe contacts the open hot rail 22 the control valve assembly 46 is moved to the open position, and when the single hot shoe contacts the close hot rail 26 the control valve assembly 46 is moved to the close position. In such an embodiment, the open hot rail 99 and close hot rail 100 typically have opposite polarity (i.e., positive and negative).

The control valve assembly 46 also includes a second actuation system in the form of a lever 102 that is coupled to the spool 90. The lever 102 is manipulated by a user between a first lever position and a second lever position. In the illustrated embodiment, the first lever position is a released position, wherein the spool 90 is moved to the open position, and the second lever position is an applied position, wherein the spool 90 is moved to the close position (as shown in FIG. 2). Alternatively, the first lever position could be the applied position and the second lever position could be the released position.

The control valve assembly 46 also includes a third actuation system in the form of a knob 106 that is coupled to the spool 90. The knob 106 is manipulated by the user between a first knob position and a second knob position. In the illustrated embodiment, the first knob position is an extended position, wherein the spool 90 is moved to the open position, and the second knob position is a retracted position, wherein the spool 90 is moved to the close position (as shown in FIG. 2). Alternatively, the first knob position could be the retracted position and the second knob position could be the extended position.

The control valve assembly 46 also includes a fourth actuation system in the form of a open pilot passage 110 and a close pilot passage 114. The open pilot passage 110 moves the spool 90 to the open position and the close pilot passage 114 moves the spool 90 to the close position. The open and close pilot passages 110, 114 are in communication with a remote actuator (not shown) such that high pressure air is selectively supplied by the remote actuator to move the spool 90 to either the open position or the close position. In the illustrated embodiment, the remote actuator is a remote pneumatic switch that may be manually switched between an open and close position by the user. Other known actuation systems can also be substituted or added.

The detailed structure of the control valve assembly 46 will be discussed with respect to FIGS. 3-7. With specific reference to FIGS. 3 and 4, the control valve assembly 46 includes a manifold block 118, a lever housing 122, a knob housing 126, and a valve housing 130. The manifold block 118 has a supply port 134 that communicates with the supply line 70, an open port 138 that communicates with the open line 74, a close port 142 that communicates with the close line 78, an open exhaust port 146 that communicates with the open exhaust 82, and a close exhaust port 150 that communicates with the close exhaust 86. Portions of the supply line 70, open line 74, close line 78, open exhaust 82, and close exhaust 86 are formed in the manifold block 118 (see FIG. 5). The manifold block 118 also includes an open pilot port 154 and a close pilot port 158 that are in communication with the open pilot passage 110 and close pilot passage 114, respectively. Additionally, portions of the open pilot passage 110 and the close pilot passage 114 are formed in the manifold block 118.

The lever housing 122 is coupled to a sealing member 123 that is sealingly attached to the valve housing 130. The lever 102 includes a shaft 162 that is coupled to the lever housing 122 by a pivot rod 166, and a lever yoke 170 is threaded or otherwise secured onto the shaft 162. In the illustrated embodiment, the lever yoke 170 is attached to a linkage (not shown, e.g., a sheathed transmission cable) that may be manipulated by the user from a remote location, such as the opposite side of the railcar 10. In other embodiments, the lever 102 may be manipulated directly.

Figure 4:
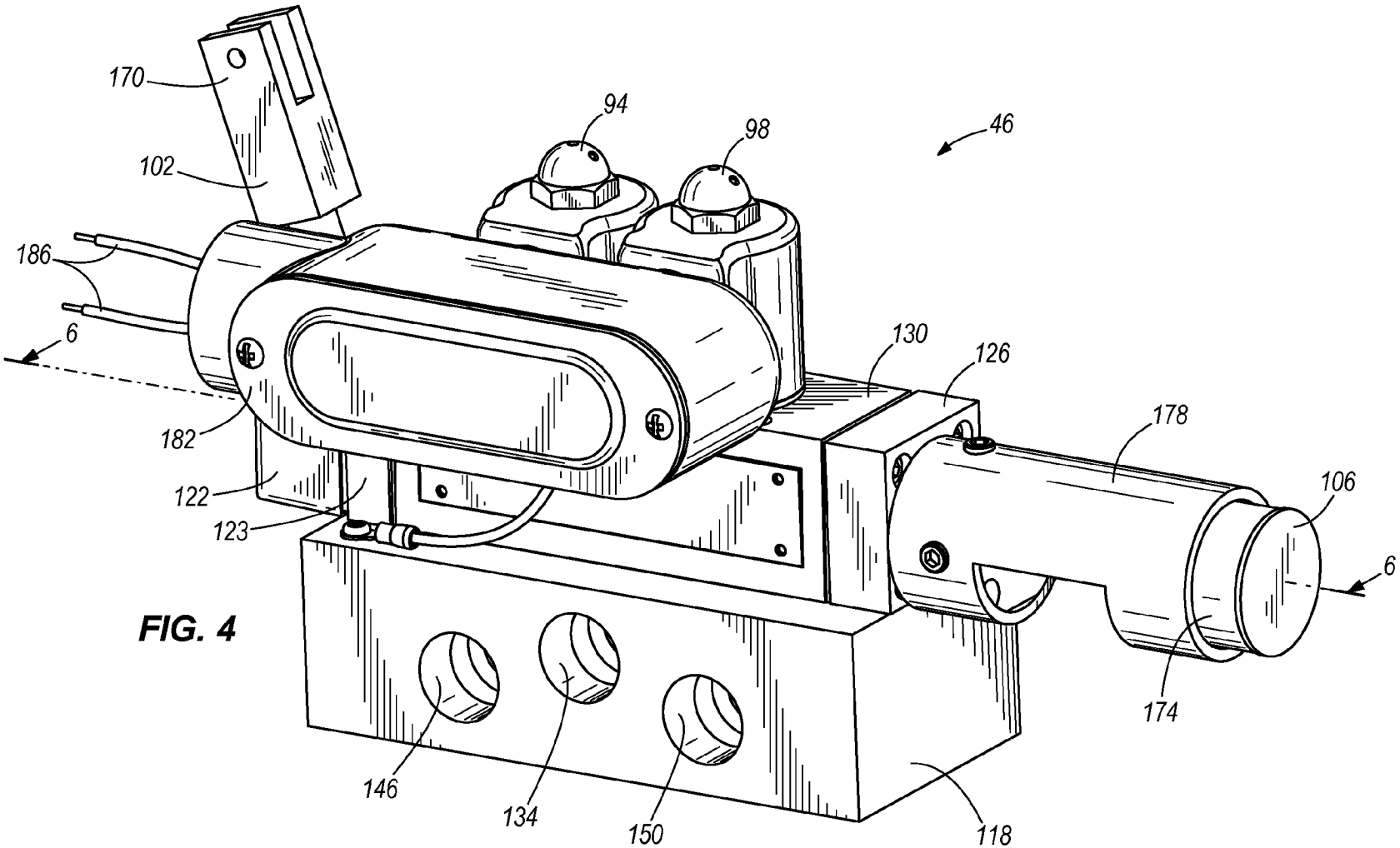
FIG. 4 is another perspective view of the control valve assembly of FIG. 3.

The knob housing 126 is sealingly attached to the valve housing 130. The knob 106 has a indication surface 174 around the periphery and is at least partially surrounded by a shroud 178 that is attached to the knob housing 126. The shroud 178 obscures the indication surface 174 and the knob 106 is disposed substantially entirely within the shroud 178 when the knob 106 is in the retracted position (FIG. 3), and the knob 106 at least partially extends outside the shroud 178 such that the indication surface 174 is visible outside the shroud 178 when the knob 106 is in the extended position (FIG. 4). In the illustrated embodiment, the end of the knob 106 is always visible. However, the sides of the knob 106 where the indication surface 174 is disposed may be hidden by the shroud 178 (e.g., when the knob is in the retracted position, FIG. 3). In another embodiment shown in FIG. 8, the shroud 178 may extend around substantially 360 degrees such that a user may not access the back side of the knob 106 with his/her hand to move the valve 46 from the closed position to the open position. In the embodiment shown in FIG. 8, a tool (not shown) is inserted into a tool access aperture 180 to shift the knob 106 from the retracted position to the extended position. The tool access aperture 180 is shown on a side of the shroud 178, however, could be located in other positions on the shroud 178 (e.g., bottom dead center). In yet another embodiment, an additional cover (not shown) may cover and/or selectively enclose the control valve assembly 46 or the shroud 178 to provide additional protection from the elements or outside vandalism (e.g., snow, ice, dirt, vandals, accidental contact).

The open and close solenoids 94, 98 are attached to the valve housing 130 and portions of the open and close solenoids 94, 98 are disposed within the valve housing 130. Additionally, a wiring conduit 182 is connected to the open and close solenoids 94, 98 and houses power lines 186 that couple the open solenoid 94 to the open hot shoe/touch pad 99 and the close solenoid 98 to the close hot shoe/touch pad 100.

Figure 5:
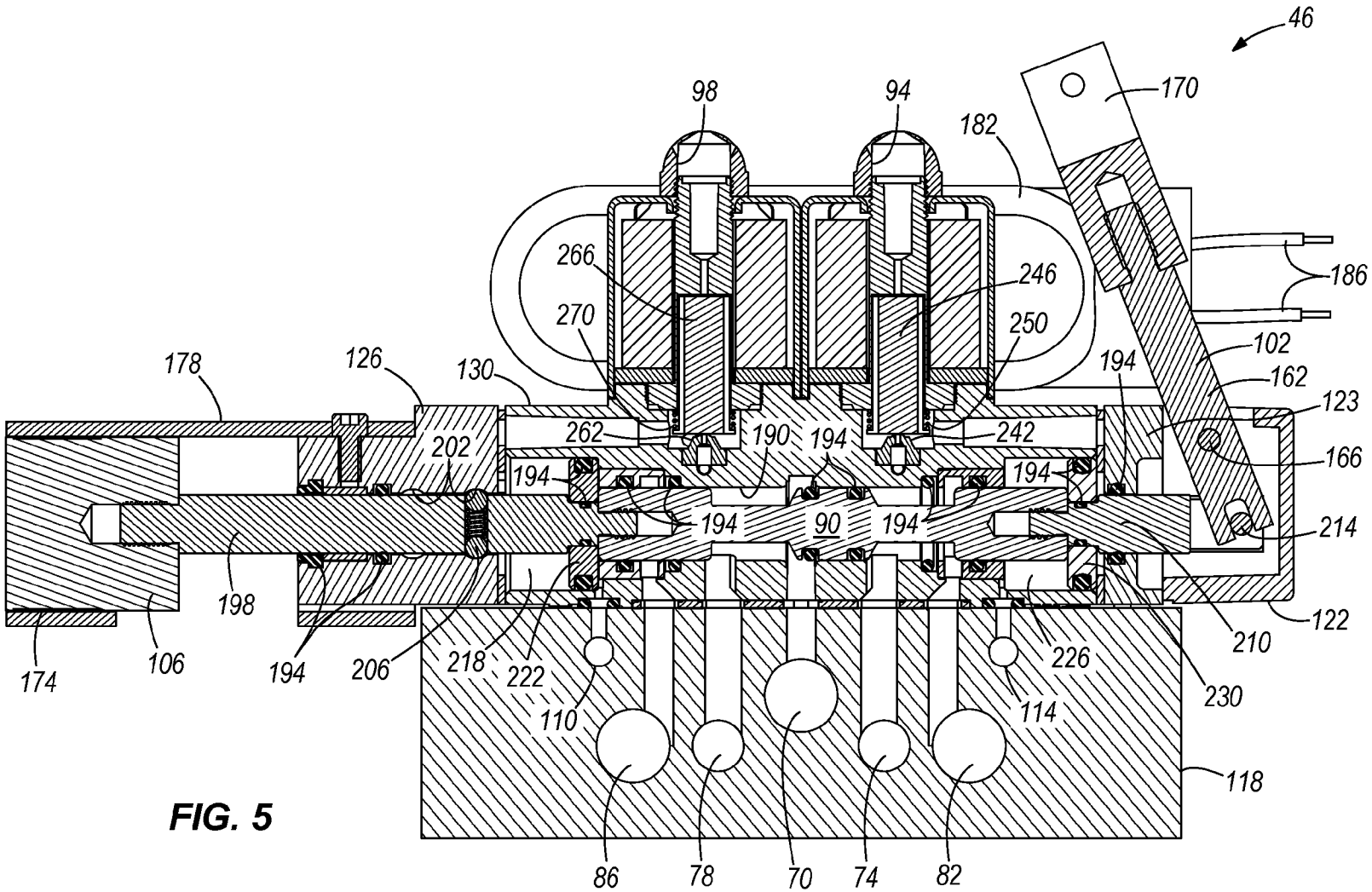
FIG. 5 is a section view of the control valve assembly taken along line 5-5 in FIG. 3 showing the control valve assembly in a first position.
Figure 6:
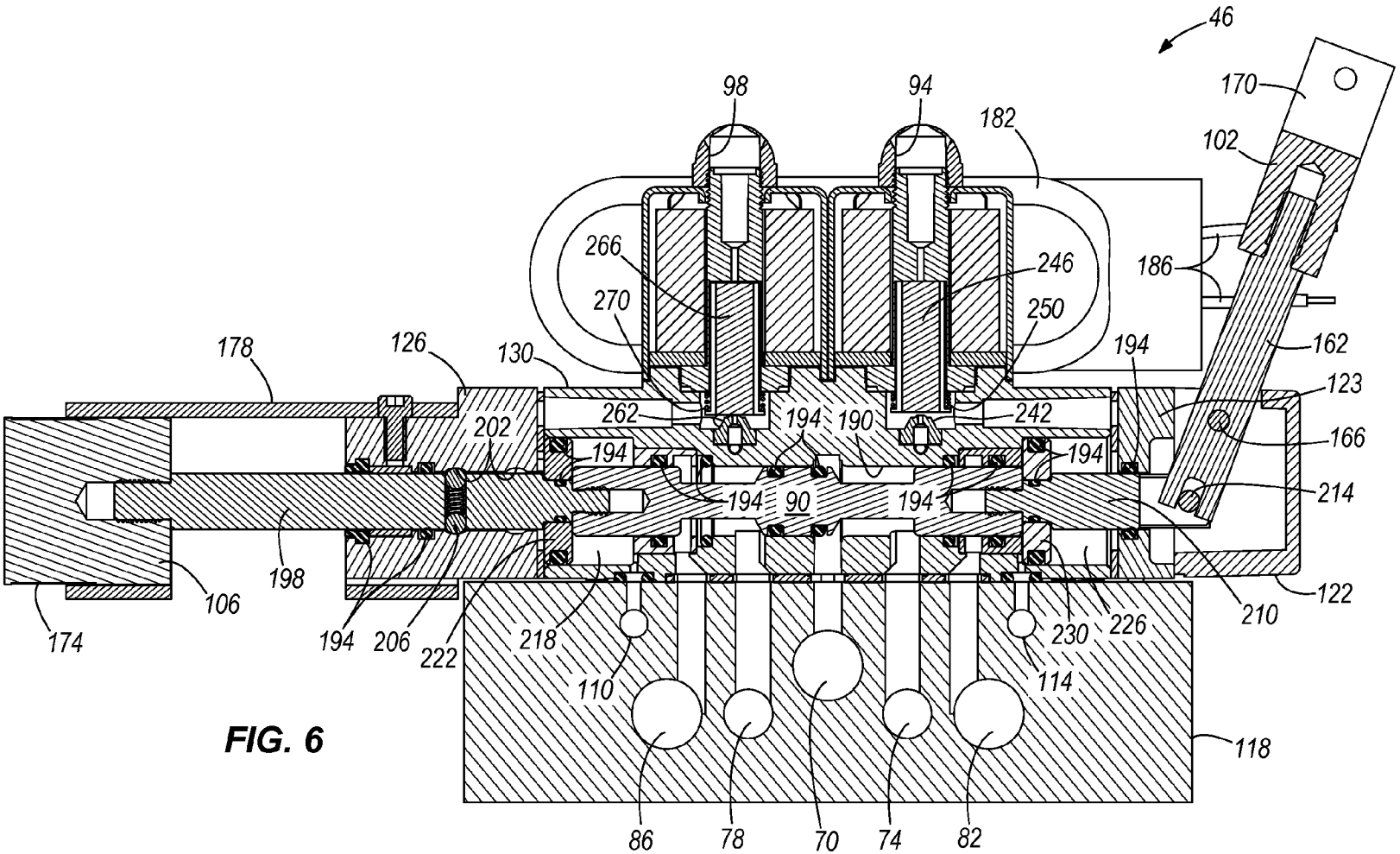
FIG. 6 is a section view of the control valve assembly taken along line 6-6 in FIG. 4 showing the control valve assembly in a second position.

Referring to FIGS. 5 and 6, the valve housing 130 includes a spool bore 190 that is shaped to receive the spool 90. Two seals 194 are positioned near the center of the spool 90 to create a sealing relationship between the spool 90 and the spool bore 190. The supply line 70, open line 74, open exhaust 82, close line 78, and close exhaust 86 communicate from the respective ports 134, 142, 146, 150, 154, 158 to the spool bore 190. Two seals 194 flank the close exhaust 86 to block communication with the spool bore 190 while the spool 90 is in the close position (FIG. 5), and likewise, two seals 194 flank the open exhaust 82 to block communication with the spool bore 190 when the spool 90 is in the open position (FIG. 6). The two outermost seals 194 in the spool bore 190 also inhibit high pressure air from escaping the valve housing 130.

The knob 106 includes a knob spindle 198 that extends through the knob housing 126 and directly threads into the spool 90. The knob housing 126 has a seal 194 that contacts the knob spindle 198 to inhibit contaminants from accessing the spool 90 or other valve components from the exterior of the control valve assembly 46. Two detent recesses 202 are formed in the knob housing 126 and a spring detent 206 is positioned on the knob spindle 198. The spring detent 206 selectively engages the detent recesses 202 and inhibits movement of the knob 106. The knob spindle 198 is directly connected to the spool 90, therefore the spring detent 206 inhibits the movement of the spool 90. To move the spool 90, a sufficient force must be applied to overcome the spring detent 206.

The lever 102 includes a lever spindle 210 that extends through the lever housing 122 and directly threads into the spool 90. The lever housing 122 has a seal 194 that contacts the lever spindle 210 to inhibit contaminants from accessing the spool 90 or other valve components from the exterior of the control valve assembly 46. The lever spindle 210 is connected to the shaft 162 by a pin and cradle arrangement 214 such that movement of the lever 102 between the applied position (FIG. 5) and the released position (FIG. 6) moves the lever spindle 210 and spool 90 between the close position (FIG. 5) and open position (FIG. 6), respectively.

The open pilot passage 110 communicates with a first chamber 218 that is formed in the valve housing 130. The knob housing 126 forms one wall of the first chamber 218. A first piston 222 is disposed within the first chamber 218 and positioned on the knob spindle 198. The first piston 222 is held rigidly in place relative to the knob spindle 198 and the spool 90 via shoulders formed in the knob spindle 198 and the spool 90. Seals 194 on the inner and outer diameters of the first piston 222 inhibit leakage of pressurized air from one side of the piston 222 to the other.

The close pilot passage 114 communicates with a second chamber 226 that is formed in the valve housing 130. The lever housing 122 forms one wall of the second chamber 226. A second piston 230 is disposed within the second chamber 226 and positioned on the lever spindle 210. The second piston 230 is held rigidly in place relative to the lever spindle 210 and the spool 90 via shoulders formed in the lever spindle 210 and the spool 90. Seals 194 on the inner and outer diameters of the second piston 230 inhibit leakage of pressurized air from one side of the piston 230 to the other.

In another embodiment, the second piston 230 is removed such that pressurized air acts only on the spool 90 itself to shift the valve 46 from the closed position to the open position. This may be desirable when a larger pressure is desired to move the valve 46 to the open position than to move the valve 46 to the closed position. The smaller surface area presented by the spool 90 (as opposed to the larger surface area presented by the piston 230) requires more air pressure to move the spool 90. In one example, an air pressure of 40 psi is required to move the valve 46 to the open position, and 10-15 psi is required to move the valve 46 to the closed position. In other embodiments, different pressures and different pressure differentials may be used, as desired.

Figure 7:
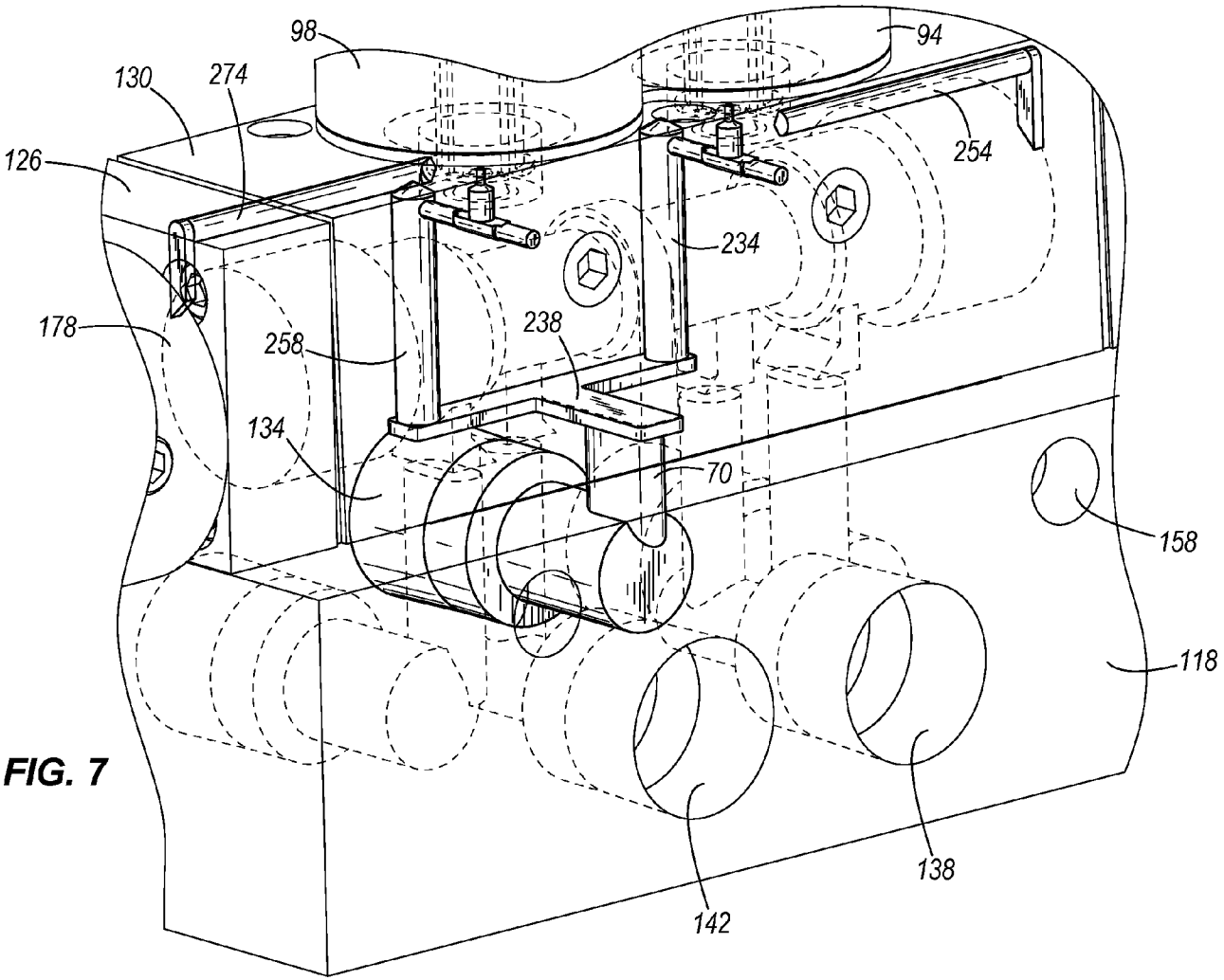
FIG. 7 is a partial view of the control valve assembly of FIG. 3 showing the pneumatic flow paths.

Referring to FIG. 7, the supply line 70 is in communication with an open solenoid supply line 234 via a T-shaped gasket 238 positioned between the manifold block 118 and the valve housing 130. The open solenoid supply line 234 provides high pressure air to the open solenoid 94.

The open solenoid 94 includes a open valve seat 242 and an open plunger 246 that is movable between a supply position (FIG. 6) and a null position (FIG. 5). The open plunger 246 is lifted from the open valve seat 242 while in the supply position. The open plunger 246 is biased toward the null position by a spring 250 and moves to the supply position when supplied with the electric signal. When the open plunger 246 is in the supply position, high pressure air communicates with an open solenoid actuation line 254 (FIG. 7) that communicates with the second chamber 226 and biases the second piston 222 such that the spool 90 is moved to the open position (FIG. 6). When the open plunger 246 is in the null position, substantially no communication exists between the open solenoid supply line 234 and the open solenoid actuation line 254.

Similar to the open solenoid 94, the supply line 70 is in communication with a close solenoid supply line 258 via the T-shaped gasket 238 positioned between the manifold block 118 and the valve housing 130. The close solenoid supply line 258 provides high pressure air to the close solenoid 98. The close solenoid 98 is substantially similar to the open solenoid 94 and includes a close valve seat 262 and a close plunger 266 that is movable between a supply position (not shown but similar to the supply position of the open plunger 246 shown in FIG. 6) and a null position (FIGS. 5 and 6). The close plunger 266 is biased toward the null position by a spring 270 and moves to the supply position when supplied with the electric signal. When the close plunger 266 is in the supply position, high pressure air communicates with a close solenoid actuation line 274 (FIG. 7) that communicates with the first chamber 218 and biases the first piston 222 such that the spool 90 is moved to the close position. When the close plunger 266 is in the null position, substantially no communication exists between the close solenoid supply line 258 and the close solenoid actuation line 274.

Figure 8:
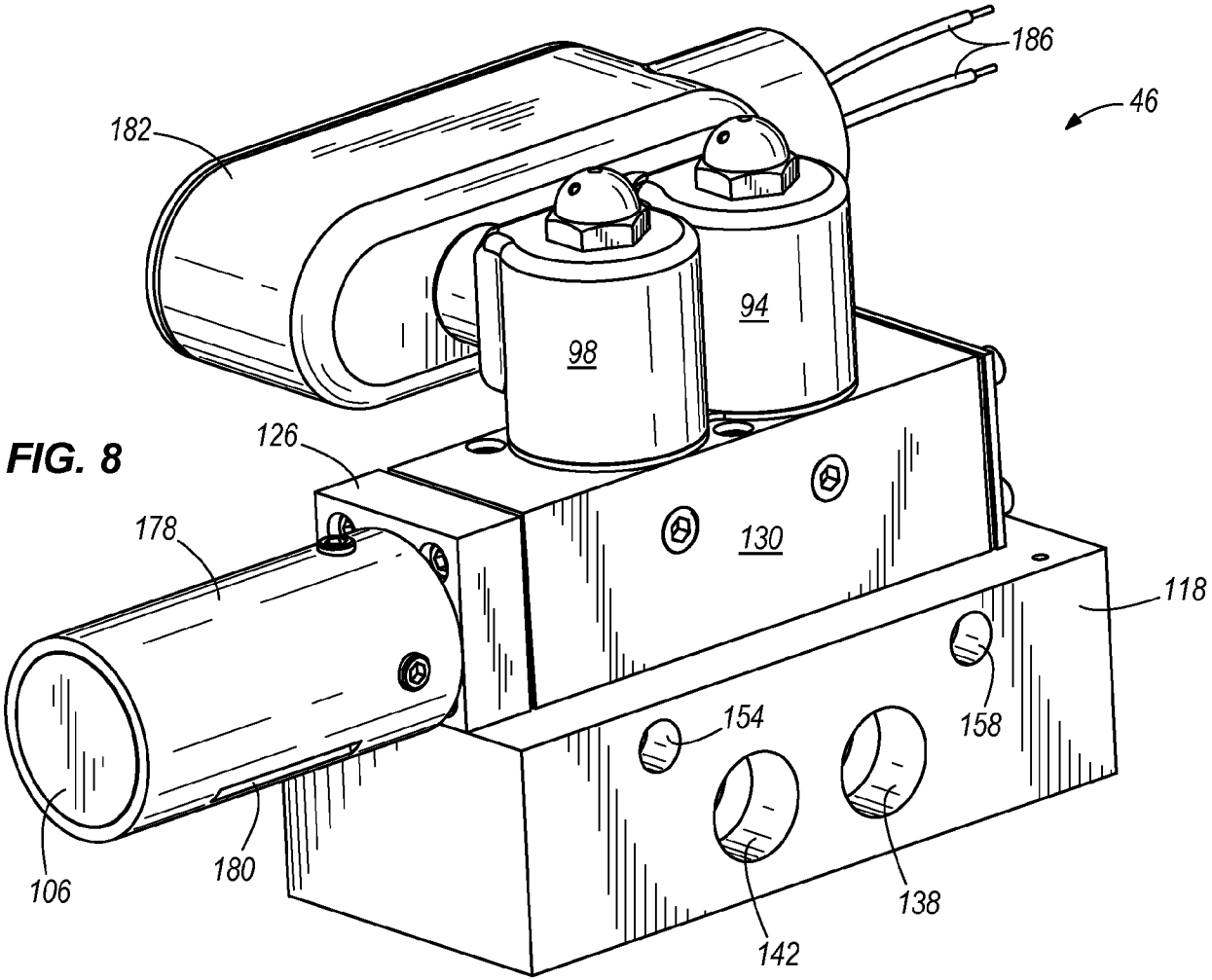
FIG. 8 is a perspective view of another embodiment of a control valve assembly embodying the invention.

FIG. 8 shows another embodiment where the lever housing 122 and lever 102 have been removed. The invention provides a valve arrangement with a high degree of flexibility that is able to meet a number of different needs that may be presented by users. For example, the knob 106 and knob housing 126, the open pilot passage 110 and the close pilot passage 114, and/or the lever 102 and lever housing 122 could be added or removed to suit the user's requirements.

In one mode of operation, as the railcar 10 approaches the dump site 18 (see FIG. 1) the user may first inspect the control valve assembly 46 to identify the position of the spool 90. If the spool 90 is in the open position, the knob 106 will be in the extended position and the indication surface 174 will be visible (see FIG. 6). The indication surface 174 is easily identified during the day and in the dark. The user may use a flashlight to inspect the control valve assembly 46 such that if the knob 106 is in the extended position the indication surface 174 will be illuminated by the flashlight. In this way, the knob 106 is a clear visual indicator of the spool 90 position and therefore the valve position. If the user identifies that the spool 90 is in the open position, the spool 90 should be actuated to the close position, either by manual manipulation of the knob 106 or the lever 102, or by use of the pilot passages 110, 114 with pressurized air from the compressed air tank 34 or from an external source. In another embodiment, the knob 106 could be in the extended position to indicate that the valve is in the closed position. With this arrangement, a user would see the indication surface 174 as an indication of a closed valve. In the illustrated embodiment, the indication surface 174 is a reflective red color and indicates that the valve is in the open position and should be moved to the closed position. In other embodiments, the indication surface 174 may be another warning color (e.g., orange), non-reflective, or have other suitable indicative characteristics, as desired.

Once the user identifies that the spool 90 is in the close position (see FIG. 5), the air compressor 38 is turned on such that high pressure air is provided to the compressed air tank 34 (see FIG. 2). High pressure air then flows through the supply line 70 and into the spool bore 190. The spool 90 is in the close position (see FIG. 5), therefore high pressure air from the supply line 70 passes to the close line 78 to apply high pressure air to the head side 66 of the piston 58 while air from the cap side 62 of the piston 58 is vented through the open line 74 and out the open exhaust 82 (see FIGS. 2 and 5). This maintains the dumping mechanism 12 in the closed position while the railcar 10 is not positioned within the dump site 18 such that inadvertent dumps are inhibited.

As the railcar 10 enters the dump site 18, the open hot shoe/touch pad 99 contacts the open hot rail 22 and the electrical signal is sent to the open solenoid 94. The open plunger 246 then moves from the null position to the supply position such that high pressure air is supplied to the second piston 230 (right side of the second piston as shown in FIGS. 5 and 6) and the spool 90 is moved to the open position (FIG. 6).

Once the spool 90 is in the open position, high pressure air from the supply line 70 communicates through the spool bore 190 and the open line 74 to apply high pressure air to the cap side 62 of the piston 58 while air from the head side 66 of the piston 58 is vented through the close line 78 and out the close exhaust 86 (see FIG. 6). This biases the actuator 50 toward the open position such that the coal 30 is dumped from the railcar 10 into the dump site 18.

After the open hot shoe/touch pad 99 breaks contact with the open hot rail 22, the solenoid spring 250 returns the open plunger 246 to the null position such that high pressure air is not provided to the second piston 230. The dumping mechanism 12 is then maintained in the open position for a predetermined length of time to ensure the load of coal 30 is fully dumped from the railcar 10.

As the railcar 10 continues to move through the dump site 18, the close hot shoe/touch pad 100 contacts the close hot rail 26 and the electrical signal is sent to the close solenoid 98. The close plunger 266 then moves from the null position to the supply position such that high pressure air is supplied to the first piston 222 (left side of the first piston as shown in FIGS. 5 and 6) and the spool 90 is moved to the close position (FIG. 5).

Once the spool 90 is in the close position, high pressure air from the supply line 70 communicates through the spool bore 190 and the close line 78 to apply high pressure air to the head side 66 of the piston 58 while air from the cap side 62 of the piston 58 is vented through the open line 74 and out the open exhaust 82 (see FIGS. 2 and 5). This biases the actuator 50 toward the close position such that the dumping mechanism 12 is closed and access to the storage space 11 is inhibited.

After the dumping mechanism 12 is closed and the close hot shoe/touch pad 100 breaks contact with the close hot rail 26, the solenoid spring 270 returns the close plunger 266 to the null position such that high pressure air is not provided to the first piston 222. The spool 90 remains in the close position such that any air remaining within the compressed air tank 34 is provided to the head side 66 of the actuator 50 to maintain the dumping mechanism 12 in the closed position.

The above described operation is an automated dumping procedure. In other embodiments, the electrical signal is sent to the hot shoes/touch pads 99, 100 manually. For example, the operator at the dump site may simply use a series of batteries connected in series that equal 24 VDC and touches the positive terminal to the desired hot shoe/touch pad 99, 100 and the negative terminal to the railcar 10 and the corresponding solenoid 94, 98 is energized. Other energy sources may also be used to energize the solenoids 94, 98, as desired.

In another mode of operation, the spool 90 may be moved between the open position and the close position manually by the knob 106 without the presence of pressurized air from the railcar 10 or any other source. The user may manually manipulate the knob 106 to shift the spool 90 between the open position and the close position. The spring detent 206 inhibits the movement of the spool 90 such that inadvertent shifting is inhibited.

In another mode of operation, the spool 90 may be moved between the open position and the close position manually by the lever 102 without the presence of pressurized air from the railcar 10 or any other source. The user may manually manipulate the lever 102 to shift the spool 90 between the open position and the close position. A linkage (not shown) may be arranged such that the user can manipulate the lever 102 from the opposite side of the railcar 10.

In another mode of operation, the spool 90 may be shifted between the open position and the close position by the open pilot passage 110 and the close pilot passage 114, respectively. Pressurized air may be supplied to the pilot passages 110, 114 by the air compressor 38 or by a different air source on or off of the railcar 10. For example, the dump site 18 may have an air compressor (not shown) that the user may connect to the open pilot passage 110 or the close pilot passage 114 to actuate the control valve assembly 46.

Conventional pilots operate by applying high pressure air to the outside of a valve to push the valve to the desired position. For example, in FIG. 5 a conventional pilot would apply pressure on the right side of the second piston 230 to shift the spool 90 to the open position. The invention provides a cross-piloting feature wherein the open pilot passage 110 provides high pressure air to the right side of the first piston 222 to move the spool 90 to the open position. In this way the open pilot passage 110 and the close solenoid 98 are not in communication and the control valve assembly 46 operates significantly better. Likewise to move the spool 90 to the close position, high pressure air is provided through the close pilot passage 114 to the left side of the second piston 230 and the spool 90 is shifted to the close position. Maintaining pilot lines and solenoid lines separate allows a user to utilize pilot features without connecting directly to the solenoid system. This design is more elegant than previous attempts and provides an improved piloting system.

The invention provides multiple actuation systems that are interconnected such that movement of one, causes movement of the others. For example, movement of the knob 106 moves the spool 90 and also the lever 102. In this way, movement of any one of the knob 106, the spool 90, and/or the lever 102 causes movement of the others of the knob 106, the spool 90, and the lever 102, and the position of the valve is indicated by the knob 106 and the lever 102.

The knob 106, the spool 90, and the lever 102 are directly connected. With respect to this application, direct connection means any mechanical connection, including linkages, such that movement of a first component directly causes the movement of a second component and movement of the second component directly causes the movement of the first component (e.g., the spool 90, the knob 106, and the lever 102).

Various features and advantages of the invention are set forth in the following claims.

What is claimed is:

1. A control valve assembly for a load carrying vehicle that includes a storage space and a dumping mechanism movable between an open position that allows access to the storage space and a closed position that inhibits access to the storage space, the control valve assembly comprising:

a housing;

a sliding valve positioned within the housing and movable between a first position, wherein the dumping mechanism is moved toward the open position, and a second position, wherein the dumping mechanism is moved toward the closed position, the sliding valve including:

a first piston coupled to a first end of the sliding valve and defining a first piston first surface and a first piston second surface, and a second piston coupled to a second end of the sliding valve opposite the first end and defining a second piston first surface and a second piston second surface, the first piston second surface facing the second piston first surface, a pilot system including:

a first pilot passage in fluid communication with the first piston second surface to selectively actuate the sliding valve toward the first position, and a second pilot passage in fluid communication with the second piston first surface to selectively actuate the sliding valve toward the second position, and a solenoid system in communication with the sliding valve and operable in response to an electrical signal to actuate the sliding valve between the first position and the second position;

wherein the solenoid system is not in fluid communication with the pilot system.

2. The control valve assembly of claim 1, wherein the electrical signal includes a first electrical signal and a second electrical signal, and the solenoid system includes a first solenoid and a second solenoid; and wherein the first electrical signal controls the first solenoid such that the sliding valve is actuated to the second position, and the second electrical signal controls the second solenoid such that the sliding valve is actuated to the first position.

3. The control valve assembly of claim 2, wherein the first solenoid is in fluid communication with the first piston first surface to selectively actuate the sliding valve toward the second position, and wherein the second solenoid is in fluid communication with the second piston second surface to selectively actuate the sliding valve toward the first position.

4. The control valve assembly of claim 1, wherein the housing includes a manifold block and at least a portion of the pilot system is formed in the manifold.

5. The control valve assembly of claim 1, wherein the first piston first surface and the first piston second surface are fluidly isolated from one-another, and wherein the second piston first surface and the second piston second surface are fluidly isolated from one-another.

6. The control valve assembly of claim 1, wherein the pilot system provides high pressured air to the sliding valve to selectively actuate the sliding valve.

7. The control valve assembly of claim 1, wherein the piloting system is a cross-piloting system.

8. The control valve assembly of claim 1, further comprising a lever directly connected to a movable member of the sliding valve and movable between a first lever position, wherein the sliding valve is moved to the first position, and a second lever position, wherein the sliding valve is moved to the second position.

9. The control valve assembly of claim 1, further comprising a knob directly connected to a movable member of the valve and movable between a first knob position, wherein the valve is moved to the first position, and a second knob position, wherein the valve is moved to the second position.

10. The control valve assembly of claim 9, wherein the knob includes an indication surface extending about a substantial portion of a periphery of the knob.

11. The control valve assembly of claim 1, further comprising a detent that inhibits movement of the sliding valve between the first position and the second position.

12. A control valve assembly for a load carrying vehicle that includes a storage space and a dumping mechanism movable between an open position that allows access to the storage space and a closed position that inhibits access to the storage space, the control valve assembly comprising:

a housing;

a sliding valve positioned within the housing and movable between a first position, wherein the dumping mechanism is moved toward the open position, and a second position, wherein the dumping mechanism is moved toward the closed position, the sliding valve including:

a first piston coupled to a first end of the sliding valve, and a second piston coupled to a second end of the sliding valve opposite the first end;

a pilot system including:

a first pilot passage in fluid communication with the first piston to selectively actuate the sliding valve toward the first position, and a second pilot passage in fluid communication with the second piston to selectively actuate the sliding valve toward the second position; and a solenoid system including:

a first solenoid in fluid communication with the first piston to selectively actuate the sliding valve toward the second position, and a second solenoid in fluid communication with the second piston to selectively actuate the sliding valve toward the first position, wherein the pilot system and the solenoid system are fluidly isolated from one another.

13. The control valve assembly of claim 12, wherein the first piston defines a first piston first surface and a first piston second surface, wherein the second piston defines a second piston first surface and a second piston second surface, the first piston second surface facing the second piston first surface, wherein the first pilot passage is in fluid communication with the first piston second surface to selectively actuate the sliding valve toward the first position, and wherein the second pilot passage is in fluid communication with the second piston first surface to selectively actuate the sliding valve toward the second position.

14. The control valve assembly of claim 13, wherein the first solenoid is in fluid communication with the first piston first surface to selectively actuate the sliding valve toward the second position, and wherein the second solenoid is in fluid communication with the second piston second surface to selectively actuate the sliding valve toward the first position.

15. The control valve assembly of claim 12, further comprising a lever directly connected to a movable member of the sliding valve and movable between a first lever position, wherein the sliding valve is moved to the first position, and a second lever position, wherein the sliding valve is moved to the second position.

16. The control valve assembly of claim 12, further comprising a knob directly connected to a movable member of the valve and movable between a first knob position, wherein the valve is moved to the first position, and a second knob position, wherein the valve is moved to the second position.

17. The control valve assembly of claim 16, wherein the knob includes an indication surface extending about a substantial portion of a periphery of the knob.

18. The control valve assembly of claim 12, further comprising a detent that inhibits movement of the sliding valve between the first position and the second position.

* * * * *